US009447710B2

(12) United States Patent
Yamakawa et al.

(10) Patent No.: US 9,447,710 B2
(45) Date of Patent: Sep. 20, 2016

(54) VARIABLE VALVE TIMING CONTROL DEVICE

(71) Applicant: AISIN SEIKI KABUSHIKI KAISHA, Kariya-shi (JP)

(72) Inventors: Yoshiaki Yamakawa, Toyota (JP); Masaki Kobayashi, Okazaki (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 94 days.

(21) Appl. No.: 14/458,835

(22) Filed: Aug. 13, 2014

(65) Prior Publication Data

US 2015/0059669 A1 Mar. 5, 2015

(30) Foreign Application Priority Data

Aug. 28, 2013 (JP) ..... 2013-177120

(51) Int. Cl.
*F01L 1/34* (2006.01)
*F01L 1/344* (2006.01)

(52) U.S. Cl.
CPC .... *F01L 1/3442* (2013.01); *F01L 2001/34426* (2013.01); *F01L 2001/34433* (2013.01); *F01L 2001/34483* (2013.01)

(58) Field of Classification Search
CPC ..... F01L 1/3442; F01L 2001/34433; F01L 2001/34483; F01L 2001/34426
USPC ..... 123/90.15, 90.17; 464/160
See application file for complete search history.

(56) References Cited

U.S. PATENT DOCUMENTS 8,397,687 B2 * 3/2013 Lichti ..... F01L 1/3442 123/90.15
2011/0168114 A1 7/2011 Kobayashi et al.
2012/0060779 A1 * 3/2012 Adachi et al.
2012/0097122 A1 * 4/2012 Lichti

FOREIGN PATENT DOCUMENTS

EP 2 428 656 A1 3/2012
JP 2003-113702 A 4/2003
JP 2012-057578 A 3/2012

OTHER PUBLICATIONS

Extended European Search Report issued on Jan. 16, 2015, by the European Patent Office in corresponding European Application No. 14182164.5-1603. (5 pages).

* cited by examiner

*Primary Examiner* — Ching Chang
(74) *Attorney, Agent, or Firm* — Buchanan Ingersoll & Rooney PC

(57) ABSTRACT

A variable valve timing control device includes a driving side rotation member, a driven side rotation member, a control valve controlling a supply and draining of an operation fluid to and from a fluid pressure chamber to change a relative rotational phase of the driven side rotation member relative to the driving side rotation member, an intermediate member positioned inwardly of the driven side rotation member between the driven side rotation member and a camshaft, the intermediate member including the control valve inwardly thereof; and a torsion spring retained by the driving side rotation member and the intermediate member to bias the driving side rotation member and the driven side rotation member either in a first rotation direction or a second rotation direction.

8 Claims, 8 Drawing Sheets

VARIABLE VALVE TIMING CONTROL DEVICE

CROSS REFERENCE TO RELATED APPLICATIONS

This application is based on and claims priority under 35 U.S.C. §119 to Japanese Patent Application 2013-177120, filed on Aug. 28, 2013, the entire content of which is incorporated herein by reference.

TECHNICAL FIELD

This disclosure generally relates to a variable valve timing control device.

BACKGROUND DISCUSSION

A known variable valve timing control device favorably includes a driven side rotation member which is formed with a lightweight material which has small rotation inertia in order to easily change a relative rotational phase of the driven side rotation member relative to a driving side rotation member. Therefore, the driven side rotation member is generally made from a low strength material, for example, an aluminum material. On the other hand, a camshaft connected to the driven side rotation member is generally made from a high-strength material, for example, an iron material. Thus, a gap is easily formed at an interface between the driven side rotation member and the camshaft due to a difference between a coefficient of linear expansion of the driven side rotation member and a coefficient of linear expansion of the camshaft. Along with that, the driven side rotation member may be easily damaged because the high-strength camshaft is directly in contact with the low-strength driven side rotation member.

Especially, in a case where a flow path of the operation fluid which changes a relative rotational phase of the driven side rotation member relative to the driving side rotation member extends over the driven side rotation member and the camshaft, and the gap is generated at the interface of the driven side rotation member and the camshaft, the relative rotational phase cannot be changed precisely at the right time, or proper timing because of the leakage of the operation fluid via the gap.

A known variable valve timing control device is disclosed in JP2012-57578A (hereinafter referred to as Patent reference 1). The variable valve timing control device disclosed in Patent reference 1 is provided with a driving side rotation member (housing), a driven side rotation member (inner rotor), a fluid pressure chamber defined between the driving side rotation member and the driven side rotation member, and a control valve controlling the supplying and draining of the operation fluid to and from the fluid pressure chamber in order to change the relative rotational phase of the driven side rotation member relative to the driving side rotation member between a most advanced angle chamber and a most retarded angle phase. The variable valve timing control device further includes an intermediate member which is positioned inwardly of the driven side rotation member between the driven side rotation member and a camshaft and includes the control valve inwardly of the intermediate member. The driven side rotation member is made from an aluminum material, whereas the intermediate member is made from an iron material.

According to the variable valve timing control device disclosed in Patent reference 1, because the variable valve timing control device includes the intermediate member which is positioned inwardly of the driven side rotation member between the driven side rotation member and the camshaft, the driven side rotation member made from the aluminum material does not come in contact with the camshaft. Thus, in a case where the camshaft is made from a high-strength material, the driven side rotation member made from the aluminum material may be prevented from being damaged. Further, because the intermediate member is made from the iron material which includes a coefficient of linear expansion that is close to a coefficient of linear expansion of the camshaft which is made from the high-strength material, the gap is not generated at the interface of the intermediate member and the camshaft. Accordingly, in a case where the flow path of the operation fluid extends over the intermediate member and the camshaft, the relative rotational phase can be changed precisely at the right time, or proper timing because the operation fluid does not leak easily.

According to the variable valve timing control device disclosed in Patent reference 1, the intermediate member is inserted from an end of the driven side rotation member to be positioned between an inner circumference of the driven side rotation member and an outer circumference of the camshaft. Thus, after mounting the driven side rotation member and the intermediate member to the driving side rotation member, the intermediate member may easily come out of the inner circumference of the driven side rotation member when the camshaft is mounted to the variable valve timing control device. Accordingly, the mounting process of the variable valve timing control device may be complicated.

A need thus exists for a variable valve timing control device which is not susceptible to the drawback mentioned above.

SUMMARY

According to an aspect of this disclosure, a variable valve timing control device includes a driving side rotation member configured to synchronously rotate with a driving shaft of an internal combustion engine, a driven side rotation member provided inwardly of the driving side rotation member to be coaxial with the driving side rotation member, the driven side rotation member integrally rotating with a camshaft for opening and closing a valve of the internal combustion engine, a fluid pressure chamber defined between the driving side rotation member and the driven side rotation member, a control valve controlling a supply and draining of an operation fluid to and from the fluid pressure chamber to change a relative rotational phase of the driven side rotation member relative to the driving side rotation member between a most advanced angle phase and a most retarded angle phase, an intermediate member being positioned inwardly of the driven side rotation member between the driven side rotation member and the camshaft, the intermediate member including the control valve inwardly thereof, and a torsion spring being retained by the driving side rotation member and the intermediate member to bias the driving side rotation member and the driven side rotation member either in a first rotation direction or a second rotation direction which is different from the first rotation direction.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Embodiments of a variable valve timing control device for controlling the timing for opening and closing an intake valve of an engine for a vehicle will be explained hereunder with reference to the drawings.

A first embodiment of the variable valve timing control device of this disclosure will be explained with reference to FIGS. 1 to 7.

Figure 1:
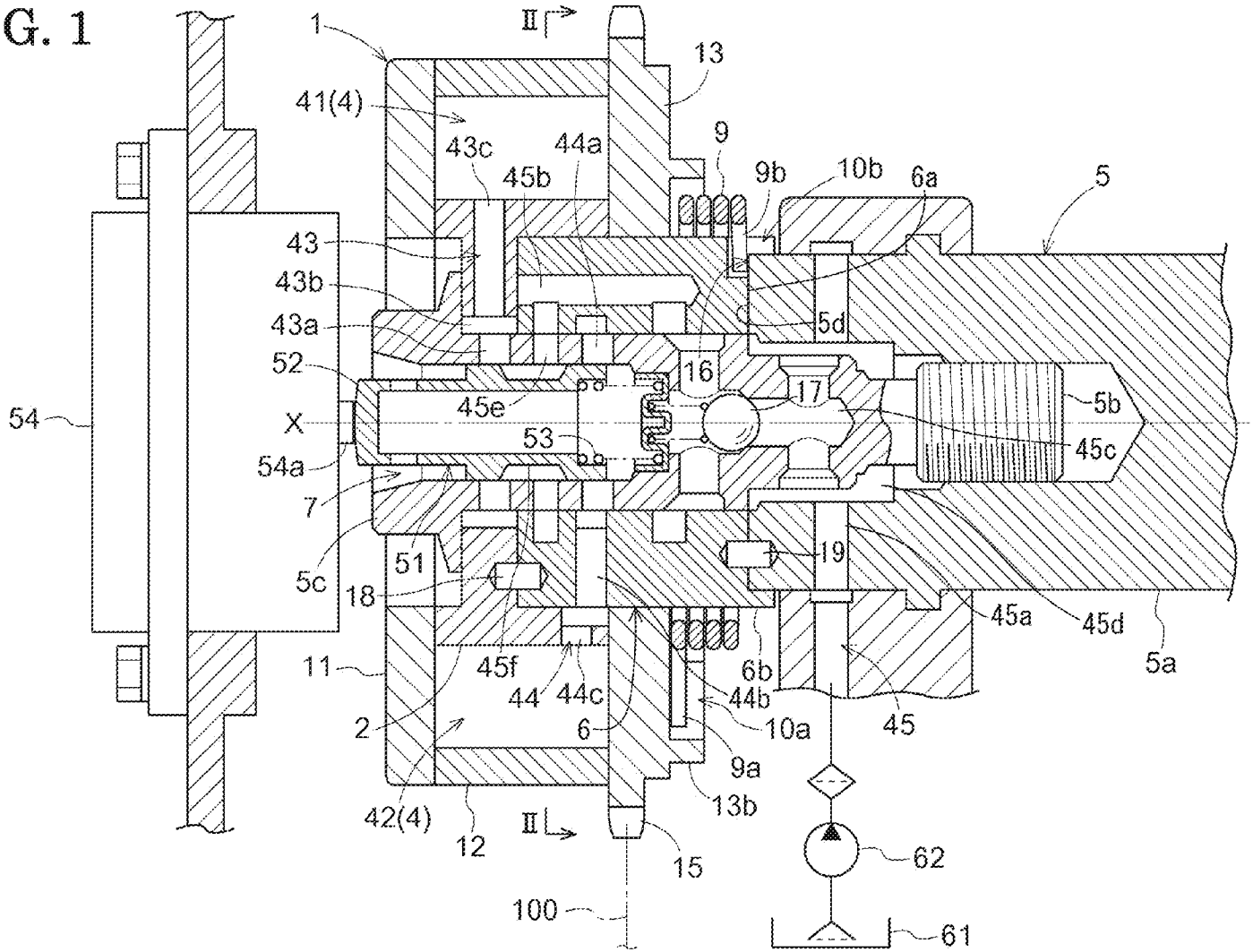
FIG. 1 is a cross sectional view illustrating an entire configuration of a variable valve timing control device according to a first embodiment disclosed here.
Figure 2:
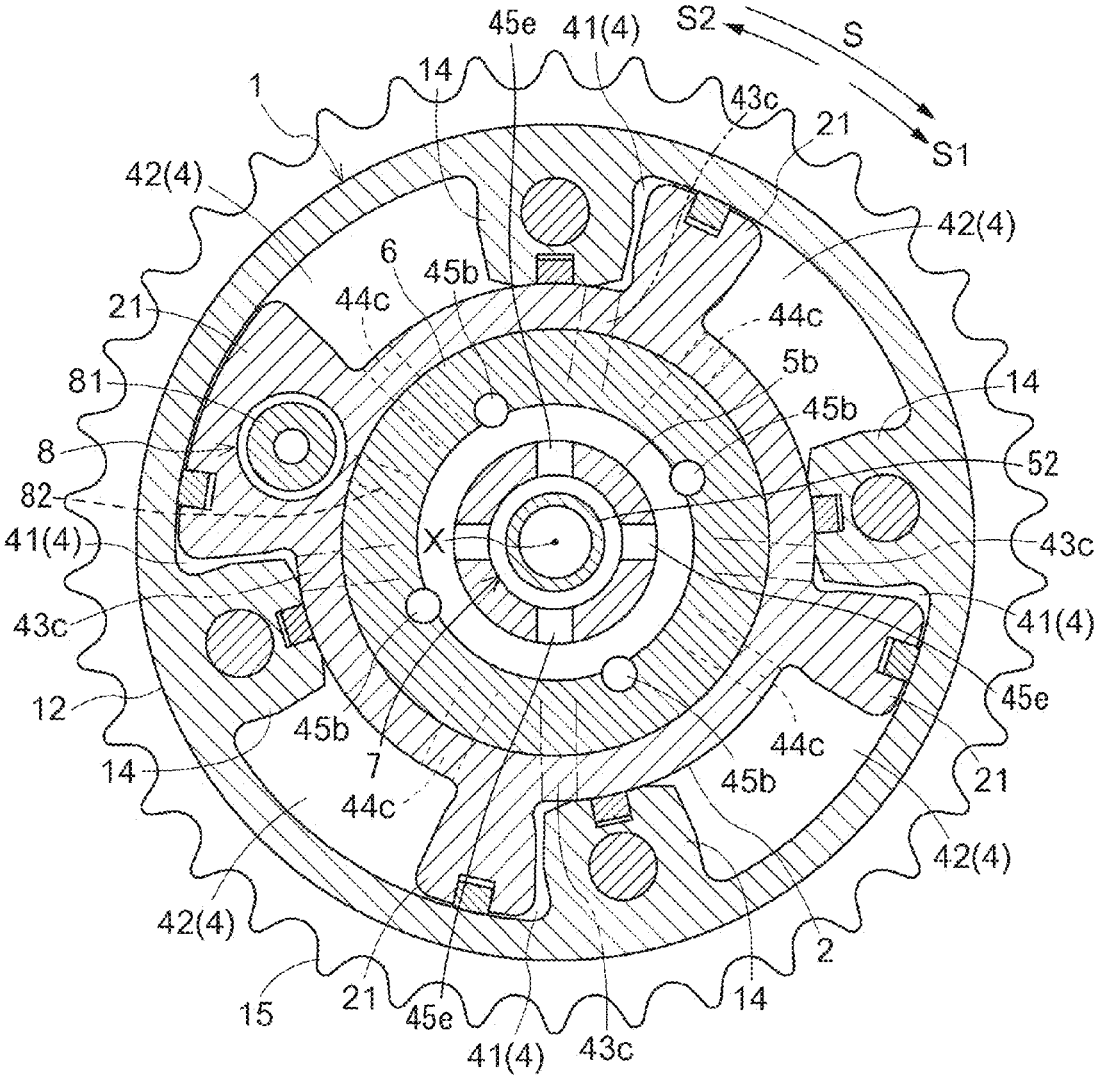
FIG. 2 is a cross-sectional view of the variable valve timing control device taken along line II-II in FIG. 1.

As shown in FIGS. 1 and 2, the variable valve timing control device includes a driving side rotation member 1 (a housing) and a driven side rotation member 2 (an inner rotor). The aluminum-alloy-made driving side rotation member 1 synchronously rotates with a crankshaft of an engine for a vehicle. The aluminum-alloy-made driven side rotation member 2 is positioned inwardly of the driving side rotation member 1 to be coaxial with the driving side rotation member 1. The driven side rotation member 2 integrally rotates with a camshaft 5 which opens and closes an intake valve of the engine.

The driven side rotation member 2 is relatively rotatably supported by the driving side rotation member 1. The camshaft 5 is coaxially configured with a camshaft body 5*a* and a steel-made oil control valve bolt 5*b*, or a steel-made OCV bolt 5*b*. The steel-made OCV bolt 5*b* is coaxially positioned within the driven side rotation member 2 and is screwed and fixed to the camshaft body 5*a*. The engine for the vehicle corresponds to an internal combustion engine, whereas the crankshaft corresponds to a driving shaft of the internal combustion engine.

A first annular oil passage 43*b* is positioned between an inner circumferential surface of the driven side rotation member 2 which faces the OCV bolt 5*b* and an outer circumferential surface of the OCV bolt 5*b*. A steel-made intermediate member 6 is provided between the inner circumference of the driven side rotation member 2, specifically, a portion of the inner circumference closer to the camshaft body 5*a*, and the outer circumferential surface of the OCV bolt 5*b*. The cylindrical intermediate member 6 is coaxially inserted into the driven side rotation member 2 to be positioned therein from a direction of the camshaft body 5*a* and transmits the rotation of the driven side rotation member 2 via the OCV bolt 5*b*. A first pin 18 is positioned to be extended over the intermediate member 6 and the driven side rotation member 2 and restrains the rotation thereof. A second pin 19 is positioned to be extended over the intermediate member 6 and the camshaft body 5*a* and restrains the rotation thereof.

The OCV bolt 5*b* is positioned inwardly of the driven side rotation member 2 and the intermediate member 6, and is screwed and fixed to an end portion of the camshaft body 5*a*. Accordingly, the driven side rotation member 2 and the intermediate member 6 integrally rotate with the camshaft body 5*a*. The camshaft body 5*a* serves as a rotation shaft of a cam which controls the opening and closing of the intake valve of the engine. The camshaft body 5*a* synchronously rotates with the driven side rotation member 2, the OCV bolt 5*b*, and the intermediate member 6. The camshaft body 5*a* is rotatably mounted to a cylinder head of the engine.

As shown in FIG. 1, the driving side rotation member 1 is integrally configured with a front plate 11, an outer rotor 12 and a rear plate 13. The front plate 11 is positioned opposite from the camshaft body 5*a* relative to the intermediate member 6. The driven side rotation member 2 is covered by the outer rotor 12. The rear plate 13 is integrally provided with a timing sprocket 15. The driven side rotation member 2 is accommodated in the driving side rotation member 1 and a fluid pressure chamber 4 is defined between the driving side rotation member 1 and the driven side rotation member 2.

When the crankshaft rotates, a rotational force is transmitted to the timing sprocket 15 via a force transmission member 100. The driving side rotation member 1 rotates in a rotation direction S shown in FIG. 2. In response to the rotation of the driving side rotation member 1, the driven side rotation member 2 is activated to rotate in the rotation direction S. Accordingly, the camshaft body 5*a* rotates and the cam being provided at the camshaft body 5*a* pushes down the intake valve of the engine to open the valve.

As shown in FIG. 2, the outer rotor 12 includes plural projections 14 protruding inwardly in a radial direction and being spaced apart in the rotation direction S. Thus, the fluid pressure chamber 4 is provided between the driven side rotation member 2 and the outer rotor 12. The projection 14 functions as a shoe relative to an outer circumferential surface of the driven side rotation member 2. Projections 21 are provided on the outer circumferential surface of the driven side rotation member 2 to be positioned at portions which face the fluid pressure chambers 4, respectively. The fluid pressure chamber 4 is divided into an advanced angle chamber 41 serving as a fluid pressure chamber and a retarded angle chamber 42 serving as a fluid pressure chamber by the projection 21 along the rotation direction S. According to the embodiment, four fluid pressure chambers 4 are provided, however, the construction is not limited to the foregoing.

The oil serving as the operation fluid is supplied to and drained from the advanced angle chamber 41 and the retarded angle chamber 42, or is blocked to be supplied to and drained from the advanced angle chamber 41 and the retarded angle chamber 42, to apply the oil pressure to the projection 21. Accordingly, the relative rotational phase of the driven side rotation member 2 relative to the driving side rotation member 1 is displaced in either the advanced angle direction or the retarded angle direction, or the relative rotational phase is maintained at a predetermined phase. The advanced angle direction is defined as a direction where the volume of the advanced angle chamber 41 increases and is indicated with an advanced angle direction S1 (serving as a first rotation direction) in FIG. 2. The retarded angle direction is defined as a direction where the volume of the retarded angle chamber 42 increases and is indicated with a retarded angle direction S2 (serving as a second rotation direction) in FIG. 2. The relative rotational phase when the volume of the advanced angle chamber 41 is maximized is defined as a most advanced angle phase. The relative rotational phase when the volume of the advanced angle chamber 42 is maximized is defined as a most retarded angle phase.

The variable valve timing control apparatus includes a lock mechanism 8 which locks, or retains the relative rotational phase of the driven side rotation member 2 relative to the driving side rotation member 1 at a predetermined lock phase which is positioned between the most advanced angle phase and the most retarded angle phase. In a state where the oil pressure is not stable immediately after starting the engine, the rotational phase of the camshaft 5 relative to the crankshaft may be maintained properly and the engine may rotate stably by locking, or retaining the relative rotational phase.

As shown in FIG. 2, a lock member 81 is movably configured along an axial direction. The lock member 81 is maintained in a locked state, or a retained state by being held in an engaged state with a lock groove provided at either the front plate 11 or the rear plate 13 by using a biasing member. A lock passage 82 is provided at the driven side rotation member 2 and connects the lock mechanism 8 and an advanced angle oil passage 43. When the advanced angle control is operated to displace the relative rotational phase of the driven side rotation member 2 relative to the driving side rotation member 1 to the advanced angle direction S1, the oil pressure is applied to the lock mechanism 8. As a result, the lock member 81 comes out of the lock groove against the biasing force applied by the biasing member to release the locked state.

As shown in FIG. 1, according to the embodiment, the OCV 51 serving as a control valve is coaxially positioned with the camshaft body 5*a*. The OCV 51 controls the supplying and draining of the oil to and from the fluid pressure chamber 4 in order to change the relative rotational phase of the driven side rotation member 2 relative to the driving side rotation member 1 between the most advanced angle phase and the most retarded angle phase. The OCV 51 includes a cylindrical spool 52, a spring 53 which biases the spool 52, and an electromagnetic solenoid 54 which activates the spool 52. The electromagnetic solenoid 54 adopts a known structure.

As shown in FIG. 1, the spool 52 is accommodated in an accommodation space 7 and is positioned closer to a head portion 5*c* of the OCV bolt 5*b*. The accommodation space 7 is formed to open towards the head portion 5*c*. The spool 52 is slidable in a direction of the axis X within the accommodation space 7. The OCV bolt 5*b* is screwed and fixed to the camshaft body 5*a* so that the OCV bolt 5*b* is fixed to the camshaft body 5*a* while sandwiching the driven side rotation member 2 and the intermediate member 6.

The spring 53 is provided inside the accommodation space 7 at a position which is positioned inwardly of the accommodation space 7 in the axial direction and constantly biases the spool 52 in a direction opposite to the camshaft body 5*a*. Upon supplying electricity to the electromagnetic solenoid 54, a push pin 54*a* provided at the electromagnetic solenoid 54 pushes the spool 52. In consequence, the spool 52 slides towards the camshaft body 5*a* against the biasing force of the spring 53. The OCV 5 is configured to regulate, or control the position of the spool 52 by regulating, or controlling a duty ratio of the electric power supplied to the electromagnetic solenoid 54. Further, the feeding amount by the OCV 51 to the electromagnetic solenoid 54 is controlled by an electric control unit, or an ECU.

Figure 3:
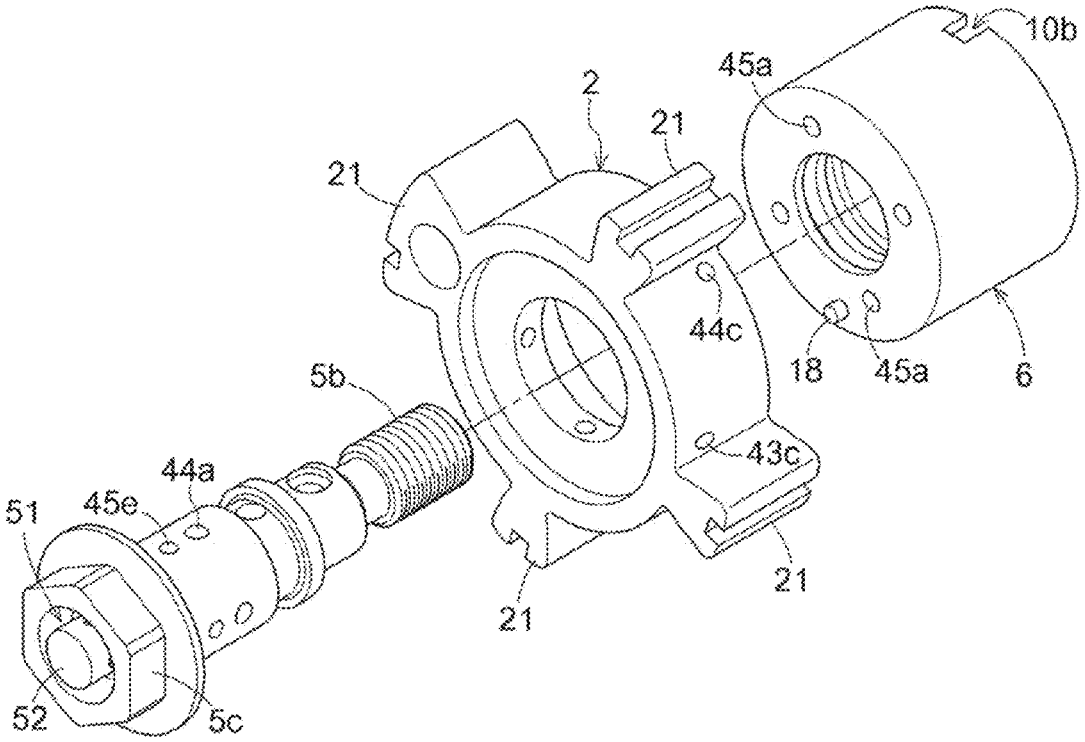
FIG. 3 is an exploded perspective view partially illustrating the configuration of the variable valve timing control device.

As shown in FIG. 3, the cylindrical intermediate member 6 is inserted into the driven side rotation member 2 from a direction of the camshaft body 5*a* (the right in FIG. 3) and holds the OCV 51 inside. The intermediate member 6 is provided inwardly of the driven side rotation member 2 between the driven side rotation member 2 and the OCV bolt 5*b*. As shown in FIG. 1, the intermediate member 6 is relatively rotatably fitted into and positioned inside a through hole 13*a* of the rear plate 13. The intermediate member 6 includes a contact surface 6*a* which protrudes from the through hole 13*a* and is in contact with an end surface 5*d* of the camshaft body 5*a*. At an outer circumference of the contact surface 6*a*, the intermediate member 6 integrally includes the circumferential wall portion 6*b* which fits onto an outer circumferential surface of the camshaft body 5*a*.

Then, in a state where the intermediate member 6 is positioned inside the driven side rotation member 2 which is fitted and surrounded by the driving side rotation member 1, the OCV bolt 5*b* is positioned inside the driven side rotation member 2 and the intermediate member 6 and is screwed and fixed to the camshaft body 5*a*. Accordingly, as shown in FIG. 1, the inner circumference of the driven side rotation member 2 is interposed between the head portion 5*c* of the OCV bolt 5*b* and the intermediate member 6 in the axial direction. In a state where the first annual oil passage 43*b* is formed between the inner circumferential surface of the driven side rotation member 2 and the outer circumferential surface of the OCV bolt 5*b*, the driven side rotation member 2, the intermediate member 6 and the camshaft body 5*a* are integrally fixed with each other.

Figure 4:
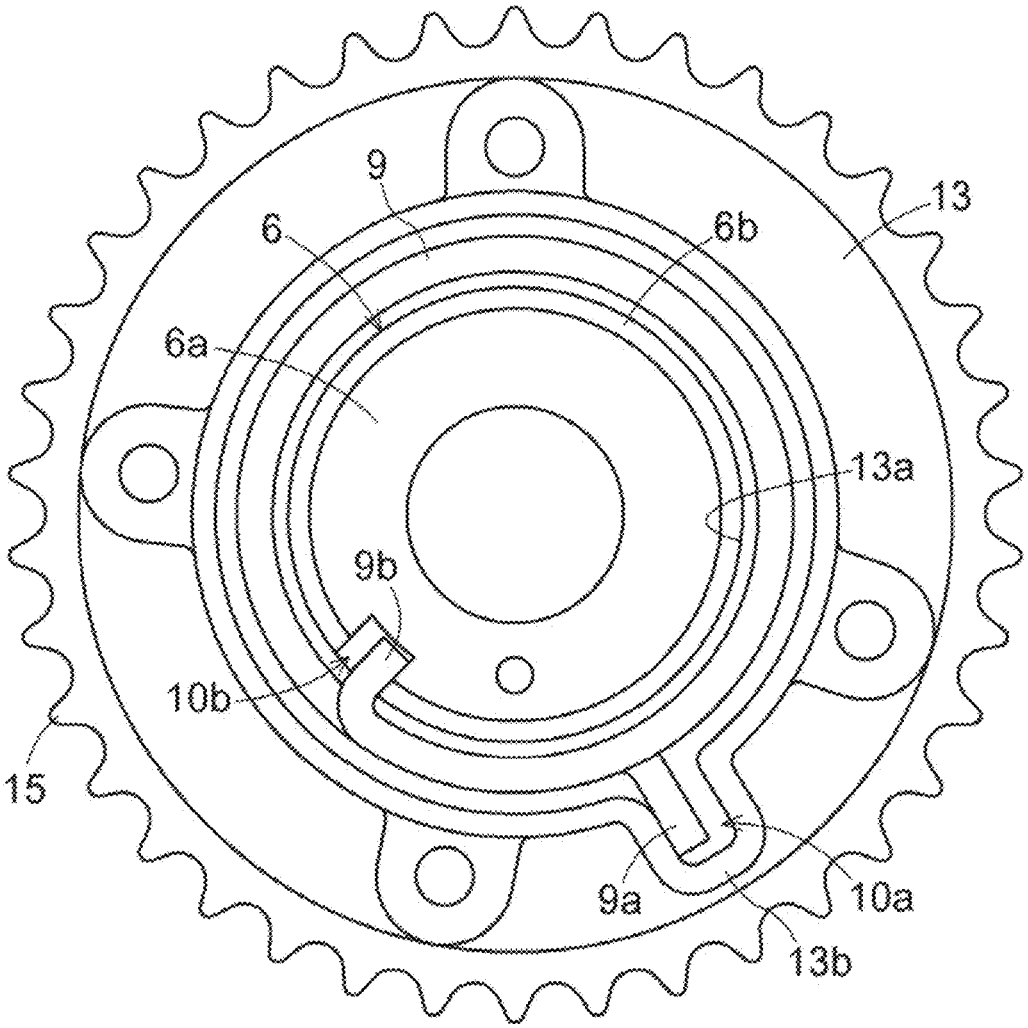
FIG. 4 is a front view of the variable valve timing control device seeing from a rear plate.

As shown in FIGS. 1 and 4, a torsion spring 9 is retained, or stopped by the rear plate 13 and the intermediate member 6 and biases the driving side rotation member 1 and the driven side rotation member 2 in the advanced direction S1 serving as a first rotation direction. The rear plate 13 is integrally configured with a circumferential wall portion 13*b* which surrounds a first end portion 9*a* (serving as an end portion) of the torsion spring 9 at an outer surface of the rear plate 13.

That is, a first stopper portion 10*a* is integrally configured with the rear plate 13, whereas a second stopper portion 10*b* is integrally configured with the intermediate member 6. The first and second stopper portions 10*a*, 10*b* retain, or stop the first end portion 9*a* and a second end portion 9*b* in a circumferential direction, respectively, in order to restrain a return deformation of the torsion spring 9 in a radially extending direction from a state where the torsion spring 9 is elastically deformed in a radially contracting direction.

According to the variable valve timing control device for the exhaust valve which is configured with the driven side rotation member 2 integrally rotating with the camshaft 5 for opening and closing the exhaust valve, the torsion spring 9 is favorably retained, or stopped by the intermediate member 6 and the rear plate 13 in order to bias the driving side rotation member 1 and the driven side rotation member 2 in the retarded angle direction S2 (corresponding to a second rotation direction which is different from the first rotation direction).

As shown in FIG. 4, the first stopper portion 10*a* of the rear plate 13 is configured to extend radially outward from the circumferential wall portion 13*b* of the rear plate 13 to retain the first end portion 9*a* of the torsion spring 9 which is positioned closer to the rear plate. The second stopper portion 10*b* of the intermediate member 6 corresponds to a stopper groove portion which extends over the circumferential wall portion 6*b* and the contact surface 6*a* of the intermediate member 6. The second stopper portion 10*b* extends from the outer circumferential surface towards the inner circumferential surface of the intermediate member 6 in a manner opening towards the camshaft body 5*a*. Thus, the second stopper portion 10*b* retains the second end portion 9*b* of the torsion spring 9 which is positioned closer to the camshaft body 5*a*. The second stopper portion 10*b* includes the stopper groove portion which opens at the contact surface 6*a* of the intermediate member 6 and whose depth value is higher than the diameter of a spring wire of the torsion spring 9.

According to the embodiment, the intermediate member 6 is relatively rotatably fitted into and positioned inside the through hole 13*a* of the rear plate 13. Thus, in a state where the torsion spring 9 is retained from the intermediate member 6 which is mounted inwardly of the driven side rotation member 2 to the rear plate 13 before mounting the camshaft 5, the biasing force of the torsion spring 9 is applied to each portion in the circumferential direction, the each portion of the rear plate 13, or the circumferential wall portion 13*b* of the rear plate 13, and the intermediate member 6, or the circumferential wall portion 6*b* of the intermediate member 6 to press contact with each other in the radial direction.

Thus, before mounting the camshaft 5 to the variable valve timing control device, a resistance force may be applied to the intermediate member 6 and the driven side rotation member 2 to prevent the intermediate member 6 from coming out of the driven side rotation member 2 by a frictional force generated at the press contact portion between the rear plate 13 and the intermediate member 6 in addition to the friction force generated between the first end portion 9*a* of the torsion spring 9 and the first stopper portion 10*a* of the rear plate 13 and between the second end portion 9*b* of the torsion spring 9 and the second stopper portion 10*b* of the intermediate member 6, respectively. Accordingly, the intermediate member 6 is further effectively prevented from coming out of the driven side rotation member 2.

In addition, as shown in FIG. 1, a retainer portion 16 prevents the second end portion 9*b* of the torsion spring 9 which is retained by the second stopper portion 10*b* from coming out of the driven side rotation member 2 along the axis X. The end surface 5*b* of the camshaft body 5*a* covers, or partially covers the second stopper recessed portion 10*b* when the camshaft 5 is connected to the intermediate member 6 so as to have the contact surface 6*a* come in contact with the end surface 5*d* of the camshaft body 5*a*. In detail, the retainer portion 16 corresponds to a part of the end surface 5*d* of the camshaft body 5*a* when the camshaft 5 is connected to the intermediate member 6 so as to have the contact surface 6*a* come in contact with the end surface 5*d* of the camshaft body 5*a*.

Thus, the second end portion 9*b* of the torsion spring 9 may be easily retained by the second stopper portion 10*b* which opens at the contact surface 6*a* of the intermediate member 6 relative to the camshaft 5. By adopting the simple configuration, the torsion spring 9 may be prevented from coming out of the intermediate member 6 by using the camshaft 5.

As shown in FIG. 1, the oil reserved in the oil pan 61 is sucked by a mechanical oil pump 62 that is actuated in response to the transmission of the rotational drive force of the crankshaft, and is supplied to an oil supply passage 45. The OCV 51 controls the supplying and draining, or the blocking operation to supply and drain the oil to and from the advanced angle oil passage 43 and the retarded angle oil passage 44.

The advanced angle oil passage 43 serves as an oil passage for changing the relative rotational phase of the driving side rotation member 1 and the driven side rotation member 2 in the advanced angle direction S1. The retarded angle oil passage 44 serves as an oil passage for changing the relative rotational phase of the driving side rotation member 1 and the driven side rotation member 2 in the retarded angle direction S2.

As shown in FIG. 1 and FIG. 2, the advanced angle oil passage 43 which communicates with the advanced angle chamber 41 is configured with a first through hole 43*a*, a first annular oil passage 43*b*, and a second through hole 43*c*. The first through hole 43*a* is provided at the OCV bolt 5*b*. The first annular oil passage 43*b* is positioned between the OCV bolt 5*b* and the driven side rotation member 2. The second through hole 43*c* is provided at the driven side rotation member 2 to communicate with the first annular oil passage 43*b* and the advanced angle chamber 41.

The retarded angle oil passage 44 which communicates with the retarded angle chamber 42 is configured with a third through hole 44*a*, an oil passage 44*b*, and a fourth through hole 44*c*. The third through hole 44*a* is provided at the OCV bolt 5*b*. The oil passage 44*b* is positioned at the intermediate member 6 to communicate with the third through hole 44*a*. The fourth through hole 44*c* is provided at the driven side rotation member 2 to communicate with the oil passage 44*b* and the retarded angle chamber 42.

The oil supply passage 45 selectively supplying the oil to the advanced oil passage 43 and the retarded oil passage 44 is configured with a first passage 45*a*, a second annular passage 45*d*, a second passage 45*c*, a fifth through hole 45*e*, a third passage 45*b*, and an annular circumferential groove 45*f*. The first passage 45*a* is provided at the camshaft body 5*a*. The second annular passage 45*d* is positioned between an inner surface of the camshaft body 5*a* and an outer surface of the OCV bolt 5*b* to communicate with the first passage 45*a*. The second passage 45*c* is provided at the OCV bolt 5*b* to communicate with the second annular passage 45*d*. The fifth through hole 45*e* is provided at the OCV bolt 5*b* between the first through hole 43*a* and the third through hole 44*a*. The third passage 45*b* is provided at the intermediate member 6 to communicate with the second passage 45*c* and the fifth through hole 45*e*. The annular circumferential groove 45*f* is provided at the spool 52 to have one of the first through hole 43*a* and the third through hole 44*a* selectively communicate with the fifth through hole 45*e*. A check valve 17 is mounted in the second passage 45*c* to block the oil from flowing into the third passage 45*b* in a state where the amount of the oil supply pressure is equal to or lower than a predetermined amount of the supply pressure while allowing the oil to flow into the third passage 45*b* in a state where the amount of the oil supply pressure is higher than the predetermined amount of the supply pressure.

The operation for supplying the oil using the OCV 51 will be explained with reference to FIG. 1 and FIGS. 5 to 7. FIG. 1 shows a state where the oil is not supplied to the oil supply passage 45 because the oil pump 62 is not activated. In this state, the electromagnetic solenoid 54 is not energized and the spool 52 is placed at a position where the oil supply passage 45 and the advanced angle oil passage 43 communicate with each other via the annular circumferential groove 45*f* by the biasing force applied by the spring 53. Thus, the check valve 17 is closed.

Figure 5:
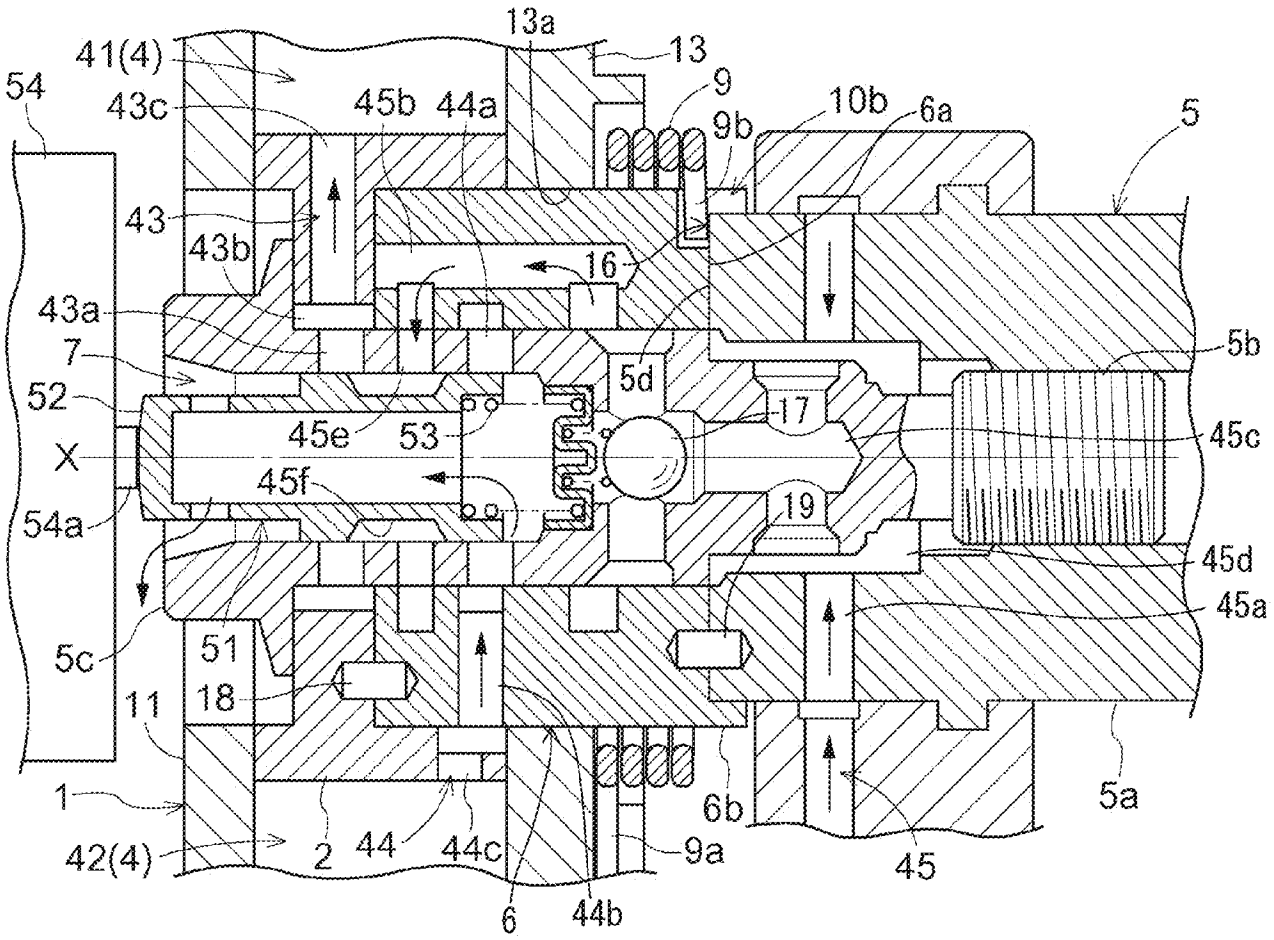
FIG. 5 is a cross-sectional view of the valve timing control device explaining the operation for supplying an oil.

FIG. 5 shows a state where the oil whose pressure level is higher than a predetermined oil pressure level is supplied to the oil supply passage 45 in response to the activation of the oil pump 62. Thus, the check valve 17 is open. In this state, the oil is supplied to the advanced angle chamber 41 via the advanced oil passage 43, whereas the oil accommodated in the retarded angle chamber 42 is drained to, for example, the oil pan 61 through the retarded angle oil passage 44 and an inside of the spool 52.

Figure 6:
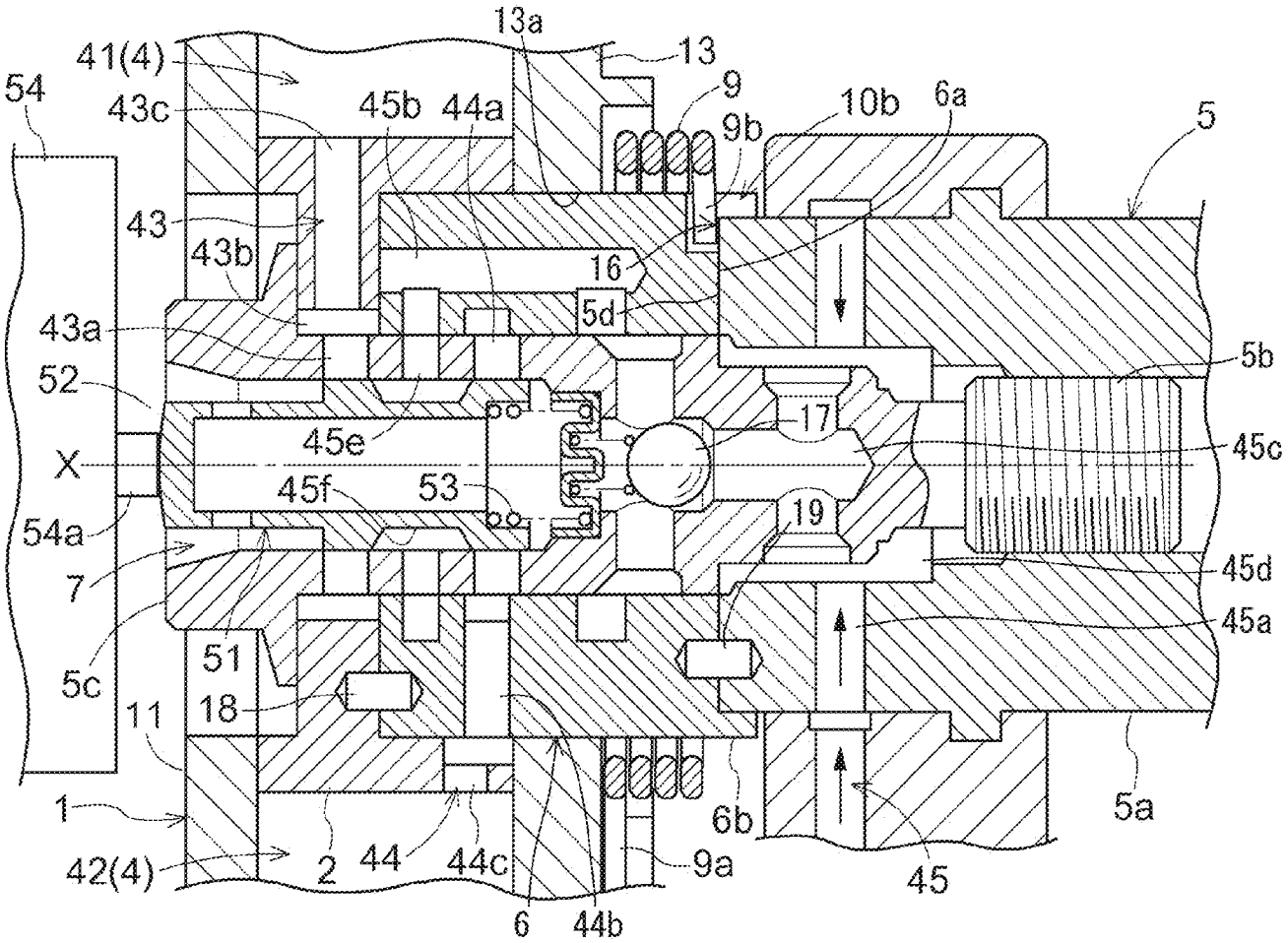
FIG. 6 is another cross-sectional view of the valve timing control device explaining the operation for supplying the oil.

FIG. 6 shows a state where the check valve 17 is opened by supplying the oil whose pressure level is higher than the predetermined pressure level to the oil supply passage 45 and the spool 52 moves to a neutral position where the annular circumferential groove 45*f* communicates with neither the advanced angle oil passage 43 nor the retarded angle oil passage 44 by activating the electromagnetic solenoid 54. In this state, the oil is supplied to neither the advanced angle chamber 41 nor the retarded angle chamber 42.

Figure 7:
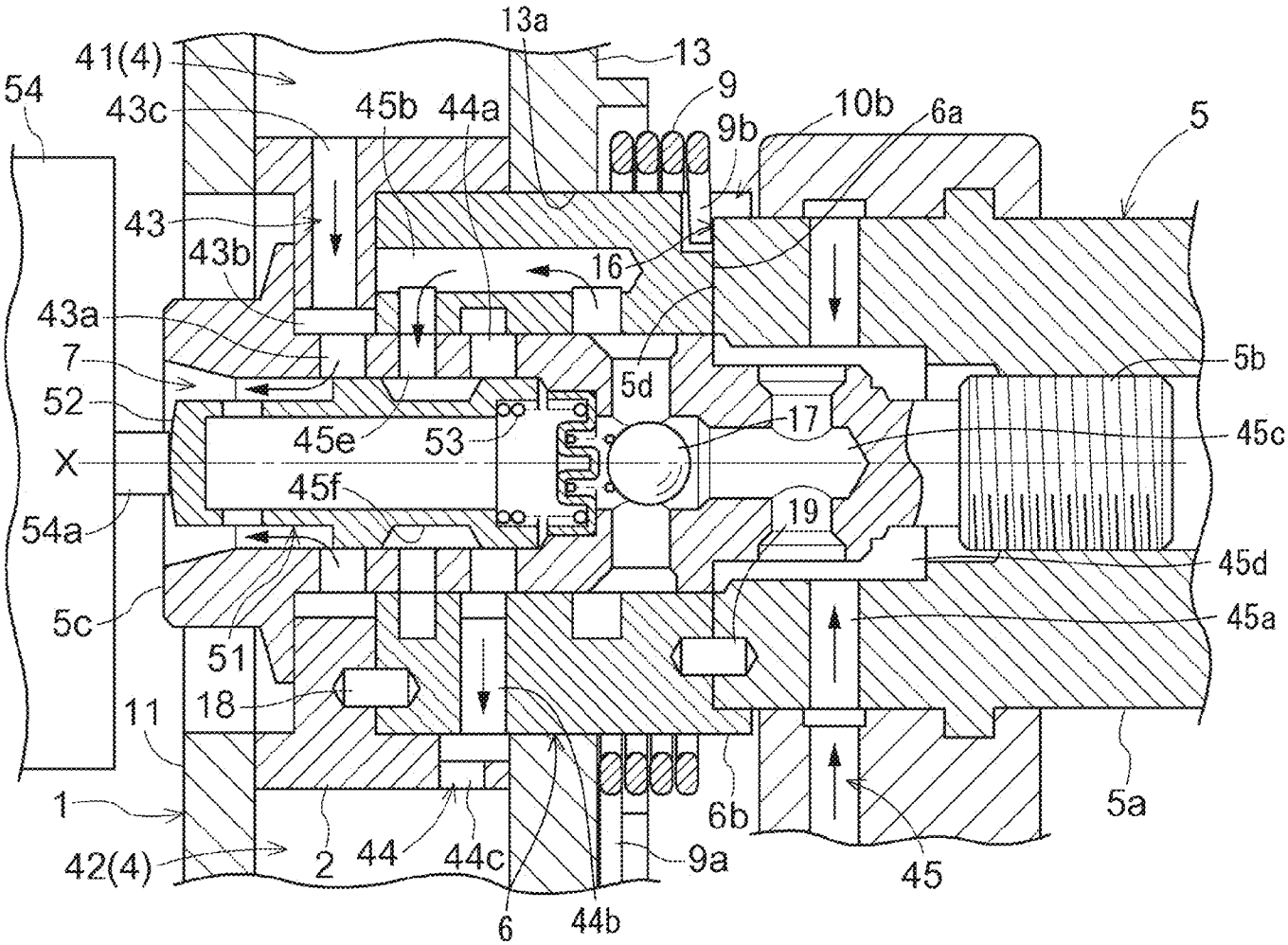
FIG. 7 is still another cross-sectional view of the valve timing control device explaining the operation for supplying the oil.

FIG. 7 shows a state where the check valve 17 is opened by supplying the oil whose pressure level is higher than the predetermined pressure level to the oil supply passage 45 and the spool 52 moves to a position where the oil supply passage 45 and the retarded angle oil passage 44 communicate with each other via the annular circumferential groove 45*f* by activating the electromagnetic solenoid 54. In this state, the oil is supplied to the retarded angle chamber 42 via the retarded angle oil passage 44 and the oil accommodated in the advanced angle chamber 41 is drained to, for example, the oil pan 61 through the advanced angle oil passage 43 and an inside of the spool 52.

Figure 8:
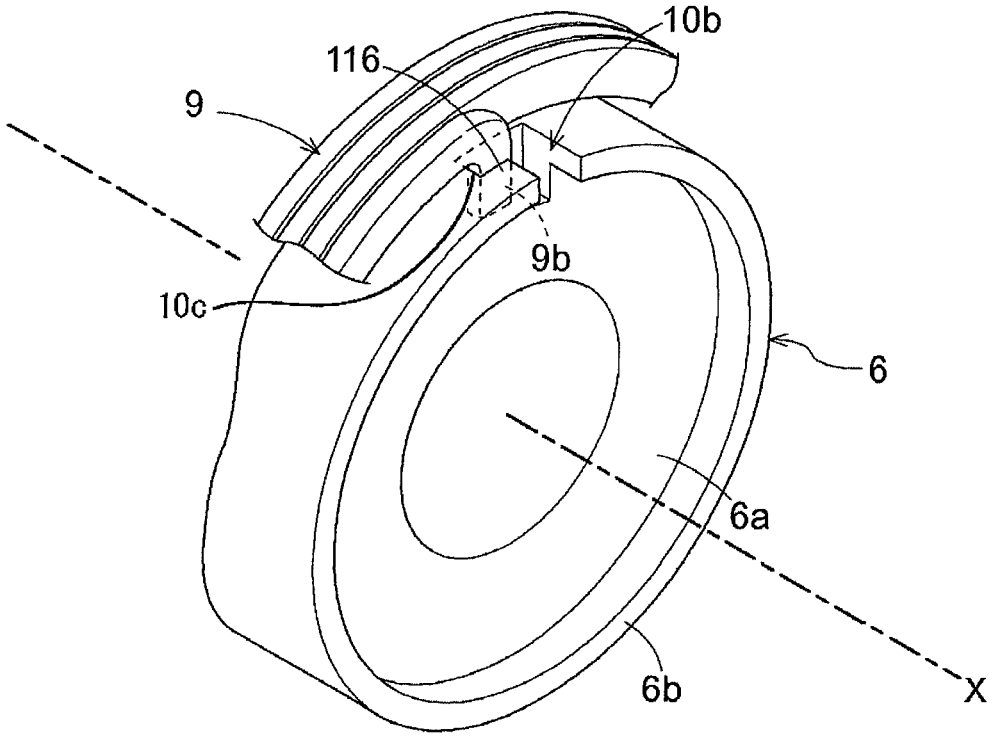
FIG. 8 is a perspective view showing a stop structure of a torsion spring according to a second embodiment.

A second embodiment of this disclosure will be explained. FIG. 8 illustrates a stop structure of the torsion spring 9 of the second embodiment of this disclosure. According to the second embodiment, a retainer portion 116 is provided at the second stopper portion 10*b* of the intermediate member 6, the second stopper portion 10*b* which retains the second end portion 9*b* of the torsion spring 9. The retainer portion 116 prevents the second end portion 9*b* of the torsion spring 9 from coming out of the intermediate member 6 along the axis X.

That is, the groove width of the second stopper portion 10*b* is set to be approximately double the diameter of the spring wire of the torsion spring 9. The retainer portion 116 is positioned at the circumferential wall portion 6*b*. The second end portion 9*b* of the torsion spring 9 pushes towards an end surface 10*c* of the second stopper portion 10*b*. The retainer portion 116 includes an extending portion which extends from a portion at the end surface 10*c* and cantilevers in the circumferential direction. The second end portion 9*b* is sandwiched by the retainer portion 116 and the circumferential surface which faces the retainer portion 116 in the axial direction. The retainer portion 116 is positioned radially outwardly of the end surface 5*d* of the camshaft 5 and the end surface 5*d* of the camshaft 5 and the retainer portion 116 restrains the end portion 9*b* of the torsion spring 9 from moving along the axis X. The second stopper portion 10*b* includes a cross-sectional shape which is formed in an L-shape when seeing from the radial direction. The second stopper portion 10*b* includes the retainer portion 116 (serving as the extending portion) extending in a circumferential direction, and the second end portion 9*b* of the torsion spring 9 is retained by the extending portion of the second stopper portion 10*b*. The configuration other than the foregoing is similar to the first embodiment.

Alternatively, the variable valve timing control device of this disclosure may be configured to prevent the driven side rotation member (2) and the intermediate member (6) from directly coming in contact with each other.

Alternatively, the variable valve timing control device of this disclosure may control the opening and closing of the exhaust valve which is provided at the internal combustion engine.

The variable valve timing control device of the disclosure is applicable to an internal combustion engine for an automobile and for other purposes.

According to the aforementioned embodiment, the variable valve timing control device includes the driving side rotation member (1) configured to synchronously rotate with the driving shaft of the internal combustion engine, the driven side rotation member (2) provided inwardly of the driving side rotation member (1) to be coaxial with the driving side rotation member (1) and integrally rotating with a camshaft (5) for opening and closing the valve of the internal combustion engine, the fluid pressure chamber (4, 41, 42) defined between the driving side rotation member (1) and the driven side rotation member (2), the control valve (51) controlling the supply and draining of an operation fluid to and from the fluid pressure chamber (4, 41, 42) to change the relative rotational phase of the driven side rotation member (2) relative to the driving side rotation member (1) between the most advanced angle phase and the most retarded angle phase, the intermediate member (6) being positioned inwardly of the driven side rotation member (2) between the driven side rotation member (2) and the camshaft (5) and including the control valve (51) inwardly thereof, and the torsion spring (9) being retained by the driving side rotation member (1) and the intermediate member (6) to bias the driving side rotation member (1) and the driven side rotation member (2) either in the first rotation direction (S1) or the second rotation direction (S2) which is different from the first rotation direction (S1).

According to the aforementioned embodiment, the torsion spring 9 is provided to be retained at the driven side rotation member 2 and the intermediate member 6 in order to bias the driving side rotation member 1 and the driven side rotation member 2 either in the first rotation direction or in the second rotation direction which is different from the first rotation direction. That is, by using the torsion spring 9 which is mounted to the driving side rotation member 1 and the intermediate member 6 to bias the driving side rotation member 1 and the driven side rotation member 2 either in the first rotation direction or in the second rotation direction which is different from the first rotation direction, the torsion spring 9 generates the reaction force which is applied to the driven side rotation member 2 and the intermediate member 6. Accordingly, the driven side rotation member 2 and the intermediate member 6 may be mounted to the variable valve timing control device to bias against each other in the rotational circumferential direction.

Accordingly, the intermediate member 6 is prevented from coming out of the driven side rotation member 2 by the friction force applied between the torsion spring 9 and the driven side rotation member 2 in addition to the friction force applied between the torsion spring 9 and the intermediate member 6. Thus, after mounting the driven side rotation member 2 and the intermediate member 6 to the driving side rotation member 1, the intermediate member 6 is prevented from coming out of the driven side rotation member 2 when mounting the camshaft 5 to the variable valve timing control device.

Thus, according to the variable valve timing control device of the embodiments, the operation fluid does not leak out easily in a case where the flow path of the operation fluid extends over the intermediate member 6 and the camshaft 5. Along with that, the driven side rotation member 2 may be prevented from being damaged by the camshaft 5 which is made from the high-strength material, that is, the driven side rotation member 2 and the camshaft 5 are connected via the intermediate member 6. Further, the variable valve timing control device may be easily assembled.

According to the aforementioned configuration, the variable valve timing control device further includes the retainer portion (16, 116) being positioned at at least one of the driving side rotation member (1) and the intermediate member (6), the driving side rotation member (1) and the intermediate member (6) which retain the torsion spring (9), the retainer portion (16, 116) preventing an end portion (first end portion 9*a*, second end portion 9*b*) of the torsion spring (9) from coming out of the driving side rotation member (1) and the intermediate member (6) along the axis (X).

According to the aforementioned configuration, the torsion spring 9 being positioned between the driven side rotation member 2 and the intermediate member 6 is prevented from being coming out of the driven side rotation member 2. Thus, after mounting the driven side rotation member 2 and the intermediate member 6 to the driving side rotation member 1, the intermediate member 6 may be reliably prevented from being coming out of the driven side rotation member 2 before mounting the camshaft 5 to the variable valve timing control device.

According to the aforementioned configuration, the second end portion (9*b*) of the torsion spring (9) is retained by the second stopper portion (10*b*) opening at the contact surface (6*a*) of the intermediate member (6) relative to the camshaft (5), the second stopper portion (10*b*) extending radially inward from the outer circumferential surface of the intermediate member (6).

According to the aforementioned configuration, torsion spring 9 may be easily mounted to the intermediate member 6 by retaining, or stopping the second end portion 9*b* of the torsion spring 9 to the second stopper portion 10*b* of the intermediate member 6, the second stopper portion 10*b* which opens at the contact surface 6*a* relative to the camshaft 5.

According to the aforementioned embodiment, the retainer portion (16) corresponds to the part of the end surface (5*d*) of the camshaft (5) when the camshaft (5) is connected to the intermediate member (6), the retainer portion (16) prevents the end portion (9*b*) of the torsion spring (9) from coming out of the intermediate member (6) along the axis (X).

According to the aforementioned configuration, by adopting the simple stop construction in which the second end portion 9*b* of the torsion spring 9 is retained, or stopped by the second stopper portion 10*b* which opens at the contact surface 6*a* of the intermediate member 6 relative to the camshaft 5, the torsion spring 9 may be prevented from coming out of the intermediate member 6.

According to the aforementioned embodiment, the intermediate member (116) includes the retainer portion (116) being positioned radially outwardly of the outer circumferential surface of the camshaft (5). The end surface (5*d*) of the camshaft (5) and the retainer portion (116) restrain the end portion (9*b*) of the torsion spring (9) from moving along the axis (X).

According to the aforementioned configuration, by adopting the simple stop construction in which the second end portion 9*b* of the torsion spring 9 is retained, or stopped by the second stopper portion 10*b* which opens at the contact surface 6*a* of the intermediate member 6 relative to the camshaft 5, the torsion spring 9 may be prevented from coming out of the intermediate member 6.

According to the aforementioned embodiment, the intermediate member (6) includes the contact surface (6*a*) being in contact with the camshaft (5). The second stopper portion (10*b*) of the intermediate member (6) opens towards the contact surface (6*a*); and the depth value of the second stopper portion (10*b*) is higher than the diameter of a spring wire of the torsion spring (9).

According to the aforementioned configuration, by adopting the simple stop construction in which the second end portion 9*b* of the torsion spring 9 is retained, or stopped by the second stopper portion 10*b* which opens at the contact surface 6*a* of the intermediate member 6 relative to the camshaft 5, the torsion spring 9 may be prevented from coming out of the intermediate member 6.

According to the aforementioned embodiment, the second stopper portion (10*b*) includes the cross-sectional shape which is formed in the L-shape when seeing from the radial direction. The second stopper portion (10*b*) includes the extending portion extending in the circumferential direction. The second end portion (9*b*) of the torsion spring (9) is retained by the extending portion of the second stopper portion (10*b*).

According to the aforementioned configuration, the torsion spring 9 being positioned between the driven side rotation member 2 and the intermediate member 6 is prevented from being coming out of the driven side rotation member 2. Thus, after mounting the driven side rotation member 2 and the intermediate member 6 to the driving side rotation member 1, the intermediate member 6 may be reliably prevented from being coming out of the driven side rotation member 2 before mounting the camshaft 5 to the variable valve timing control device.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A variable valve timing control device, comprising:

a driving side rotation member configured to synchronously rotate with a driving shaft of an internal combustion engine;

a driven side rotation member provided inwardly of the driving side rotation member to be coaxial with the driving side rotation member, the driven side rotation member integrally rotating with a camshaft for opening and closing a valve of the internal combustion engine;

a fluid pressure chamber defined between the driving side rotation member and the driven side rotation member;

a control valve controlling a supply and draining of an operation fluid to and from the fluid pressure chamber to change a relative rotational phase of the driven side rotation member relative to the driving side rotation member between a most advanced angle phase and a most retarded angle phase;

an intermediate member being positioned inwardly of the driven side rotation member between the driven side rotation member and the camshaft, the control valve being positioned inwardly of the intermediate member;

a retainer portion provided on the intermediate member; and a torsion spring directly retained by the driving side rotation member and the retainer portion of the intermediate member to bias the driving side rotation member and the driven side rotation member either in a first rotation direction or a second rotation direction which is different from the first rotation direction.

2. The variable valve timing control device according to claim 1, wherein the intermediate member retains the torsion spring, the retainer portion preventing an end portion of the torsion spring from coming out of the intermediate member along an axis.

3. The variable valve timing control device according to claim 1, wherein an end portion of the torsion spring is retained by a stopper portion opening at a contact surface of the intermediate member relative to the camshaft, the stopper portion extending radially inward from an outer circumferential surface of the intermediate member.

4. The variable valve timing control device according to claim 3, wherein the retainer portion corresponds to a part of an end surface of the camshaft when the camshaft is connected to the intermediate member, the retainer portion prevents the end portion of the torsion spring from coming out of the intermediate member along the axis.

5. The variable valve timing control device according to claim 4, wherein:

the intermediate member includes a contact surface being in contact with the camshaft;

the stopper portion of the intermediate member opens towards the contact surface; and a depth value of the stopper portion is higher than a diameter of a spring wire of the torsion spring.

6. The variable valve timing control device according to claim 4, wherein:

the stopper portion includes a cross-sectional shape which is formed in an L-shape when seeing from a radial direction;

the stopper portion includes an extending portion extending in a circumferential direction; and the end portion of the torsion spring is retained by the extending portion of the stopper portion.

7. The variable valve timing control device according to claim 3, wherein:

the retainer portion is positioned radially outwardly of an outer circumferential surface of the camshaft; and an end surface of the camshaft and the retainer portion restrain the end portion of the torsion spring from moving along the axis.

8. The variable valve timing control device according to claim 1, wherein the intermediate member forms an oil passage between the driven side rotation member and the control valve.

* * * * *